US006152862A

United States Patent [19]

Hobbs

[11] Patent Number: 6,152,862

[45] Date of Patent: Nov. 28, 2000

[54] HAND HELD DRINK DISPENSER

[76] Inventor: John R. Hobbs, P.O. Box 202, Goodland, Fla. 34140-0202

[21] Appl. No.: 09/133,551

[22] Filed: Aug. 13, 1998

[51] Int. Cl.[7] ..... A63B 71/00; A63B 21/065; B67C 9/00; B67D 3/00

[52] U.S. Cl. ..... 482/74; 482/93; 482/94; 482/105; 482/108; 222/142.8; 222/144.5; 222/145.1; 222/472; 222/561; 206/217; 220/914; 224/148.1; 224/218

[58] Field of Search ..... 482/44, 74, 93, 482/94, 105, 108, 111, 112; 473/550; 206/217; 224/148.1, 217, 218; 222/142.6, 142.8, 144.5, 145.1, 129, 472, 470, 561, 175; 220/914

[56] References Cited

U.S. PATENT DOCUMENTS

| | | | |
|---|---|---|---|
| D. 297,961 | 10/1988 | Egger | D21/682 |
| 869,702 | 10/1907 | Friend | 222/144.5 |
| 1,077,459 | 11/1913 | Driscoll | 222/142.8 |
| 4,575,074 | 3/1986 | Damratoski | 482/93 |
| 4,651,988 | 3/1987 | Sobel | 482/139 |
| 4,702,473 | 10/1987 | Paquette . | |
| 4,703,927 | 11/1987 | Hanzlik | 482/74 |
| 4,712,794 | 12/1987 | Hall . | |
| 4,988,097 | 1/1991 | Smith et al. | 482/105 |
| 5,433,350 | 7/1995 | Graubart | 222/144.5 |
| 5,580,343 | 12/1996 | Cafiero | 482/139 |
| 5,588,550 | 12/1996 | Meyer | 222/144.5 |
| 5,620,112 | 4/1997 | Brown | 220/703 |
| 5,669,529 | 9/1997 | Levit | 222/78 |
| 5,827,946 | 1/1999 | Brown | 482/108 |
| 5,890,627 | 4/1999 | Storey | 222/142.6 |

*Primary Examiner*—Richard J. Apley
*Assistant Examiner*—Victor Hwang

[57] ABSTRACT

A hand-held drink dispenser has a main housing (1) and a parallel second housing (4) that is a handle. Both are attached to a base plate (7) and covered with a funneled cap (13) having a funnel spout (14) that is sized and shaped to fit in a user's mouth to funnel liquid from a plurality of reservoirs (2, 5) in the main housing and in the second housing. A cushiony support (15) between the handle and the main housing helps hold the dispenser in order to relax holding grip for allowing the user to concentrate on physical activities and other concerns. Separate reservoirs prevent sloshing of the liquid and provide measured output from each of a pair of left-hand and right-hand units while also allowing balance of weight of liquid in each hand. Weight-attachment (16) and item-attachment (18, 19, 20) means are optional.

13 Claims, 2 Drawing Sheets

HAND HELD DRINK DISPENSER

BACKGROUND OF THE INVENTION

1. Field of the Invention

My invention relates to exercise equipment and more particularly to drink dispensers to be carried by individuals when running, walking, rollerblading or engaging in other exercise and athletic activities.

2. Relation To Prior Art

To meet a need of athletes and exercisers who become thirsty but are reluctant to stop to quench their thirst, a variety of on-the-run thirst quenchers are known. Examples of different but related devices intended to meet this need are described in the following patent documents. U.S. Pat. No. 4,702,473, issued to Paquette, described a combination hand weight and water dispenser that included a water-discharge aperture operated by a user's mouth. U.S. Pat. No. 4,712,794, issued to Hall, described a jogger's fluid-weighted exercise jug with a mouth-operated liquid-dispensing cap to be held in both hands to facilitate body balance.

SUMMARY OF THE INVENTION

My invention provides a hand-held liquid dispenser which:

Is finger operated by athletes or exercisers drinking from it without interrupting their activities or occupying their minds;

Avoids movement of liquid with erratic weight changes and sloshing sounds in hand-held liquid dispensers;

Can dispense liquid equally from dispensers in both hands to facilitate weight balance;

Provides measured amounts of liquid intake when exercising;

Allows optional attachment of weights for exercise objectives;

Has a cushiony handle support for convenient upended drink positioning and for being carried laxly in variable hand positions without distraction from physical activities and other concerns;

Is both light weight and inexpensive to manufacture.

Briefly put, my hand-held liquid dispenser includes an upstanding main housing containing several upstanding liquid reservoirs open at their upper ends, a generally cylindrical upstanding second housing offset from the main housing containing an upstanding liquid reservoir open at its upper end, sealing means lying above the upper ends of the liquid reservoirs which individually seals each of the liquid reservoirs and which includes triggering means operable by a finger when holding the dispenser to selectively and individually unseal each liquid reservoir. A funnel-shaped cap covering the openings in the several liquid reservoirs has an upstanding spout fitted to the lips of users for convenient thirst quenching.

When exercising athletes carrying the dispenser desire a drink, they use a finger to work a valve to unseal one of the liquid reservoirs, upend the dispenser, put the spout in their mouth and immediately receive a liquid to drink from the dispenser.

Preferably, the exercising athlete carries one of my liquid dispensers in each hand and first drinks from one dispenser and then from the other in order to maintain weight balance.

To make it easy to hold when drinking or carrying it on the run, my liquid dispenser has a cushiony support of soft resilient material that fits snugly over a back of the hand. An athlete's attention can be occupied with exercise and other matters instead of being diverted by gripping action. The cushiony support is mounted onto a wall of the main housing from which it is pressed softly but snugly against a back of a hand that is holding a handle that is parallel to the cushiony support and the wall to which it is attached. The handle is generally cylindrical while the main housing is sized and shaped to hold a desired amount of liquid contained in the handle.

Attachment of an exercise implement such a weight to the dispenser is optional.

BRIEF DESCRIPTION OF DRAWINGS

This invention is described by appended claims in relation to description of a preferred embodiment with reference to the following drawings which are described briefly as follows:

DESCRIPTION OF PREFERRED EMBODIMENT

Terms used to describe features of this invention are listed below with numbering in the order of their initial use with reference to the drawings. These terms and numbers assigned to them designate the same features wherever used throughout this description.

Figures 1, 2, 3:
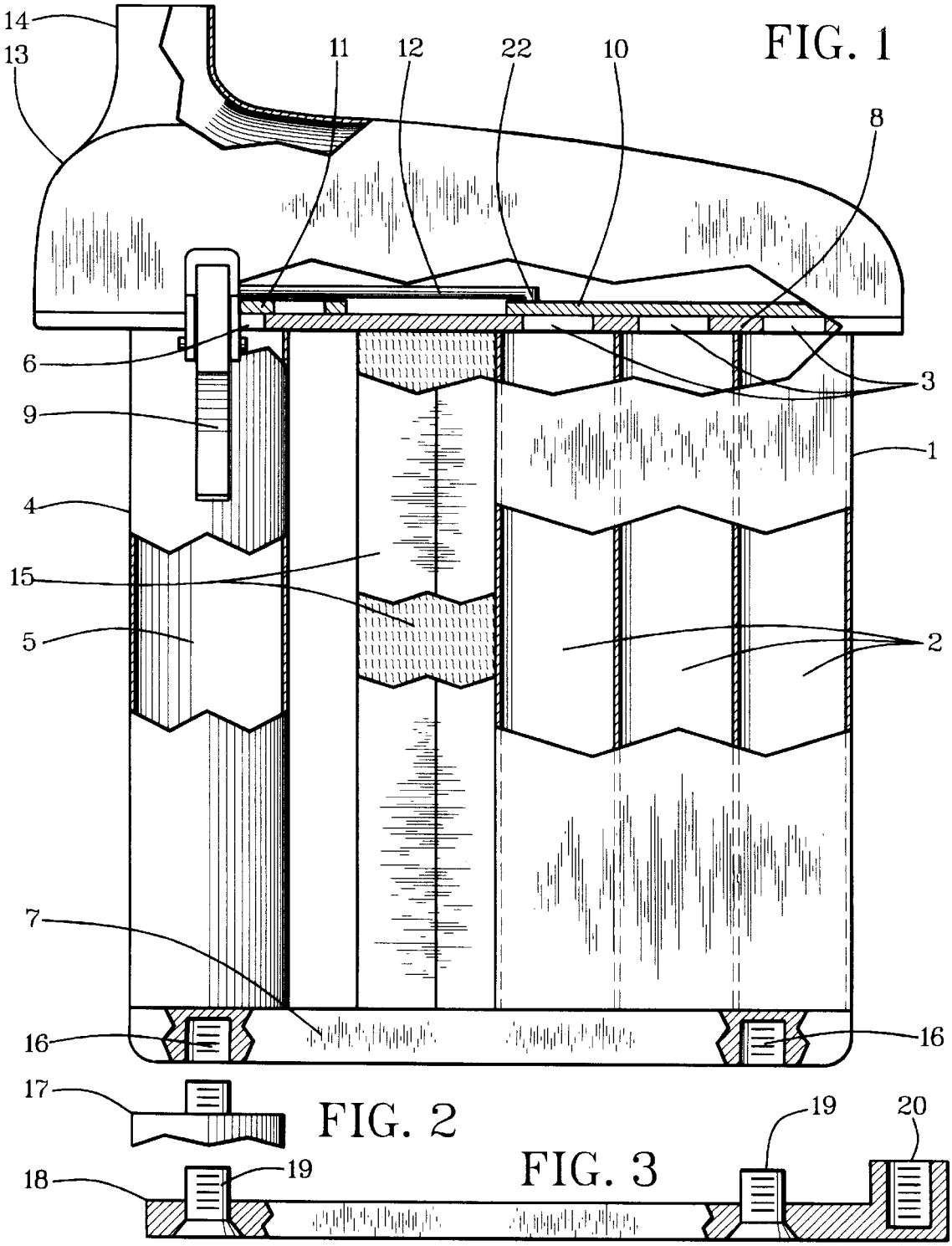
FIG. 1 is a partially cutaway side elevation view.
FIG. 2 is a top portion of an attachment weight.
FIG. 3 is a partially cutaway side view of an attachment bracket.

1. Main housing
2. Liquid reservoirs
3. Openings
4. Second housing
5. Handle reservoir
6. Handle-reservoir opening
7. Base plate
8. Cover plate
9. Valve trigger
10. First slide plate
11. Second slide plate
12. Valve line
13. Funneled cap
12. Liquid reservoirs
14. Funnel spout
15. Cushiony support
16. Fastener orifices
17. Weight
18. Attachment bracket
19. Bracket fasteners
20. Item fastener
21. Slide-plate opening
22. Hook
23. Ratchet spring
24. Hook notches Reference is made first to FIGS. 1–3. A hand-held drink dispenser has a main housing 1 that contains a plurality of liquid reservoirs 2 having openings 3 at upper ends. Offset parallel to the main housing 1 a second housing 4 for use as a handle and containing a handle reservoir 5 having a handle-reservoir opening 6 at its upper end. The main housing 1 and the second housing 4 are generally elongate and extended intermediate a base plate 7 at bottom ends and a cover plate 8 at upper ends. The second housing 4 is a handle that is oriented variously horizontal when being hand-held during physical activities of a user. When positioned with the base plate 7 on a platform such as a table, bench, shelf or sink for storage or for filling the plurality of liquid reservoirs 2 and the handle reservoir 5 with liquid, the main housing 1 and the second housing 4 are upright vertically. When being carried by a user during physical activities, the housings 1 and 4 can be oriented variously in attitudes that are convenient for the user.

The openings 3 and 6 can be positioned in the cover plate 8 and can be valved with a selection of valve means which can be operated individually and selectively with a triggering means such as a valve trigger 9. A preferred valve is a slide valve with a first slide plate 10 and a second slide plate 11. The first slide plate 10 is pulled in a direction towards the second housing 4 by a valve line 12 in response to finger pressure on the valve trigger 9 to uncover the openings 3 and 6 separately. A selection of ratchet means can be employed to uncover the openings 3 and 6 sequentially with sequentially separate digit pressure of the user on the valve trigger 9.

Enclosing the upper ends of the liquid reservoirs 2 and 5 is a funneled cap 13 having a funnel spout 14 that is sized and shaped to fit into mouths of users.

The funnel spout 14 can be oblong as depicted, round or shaped otherwise as desired. The funneled cap 13 is removable for cleaning and filling the reservoirs 2 and 5 and for cleaning the drink dispenser.

To quench thirst while continuing select physical activities, a user's head is tipped backwardly and the hand-held drink dispenser is upended to position the funnel spout 14 in or above the user's mouth while the valve trigger 9 is being squeezed to release liquid from the reservoirs 2 and 5 sequentially as desired. The liquid flows downward from upended reservoirs 3 and 6 and continues to flow downward through the funneled cap 13 and the funnel spout 14 to the user's mouth.

To stabilize my hand-held drink dispenser in a user's hand while being drunk from and while being carried, a cushiony support 15 is positioned intermediate the main housing 1 and the second housing 4. The cushiony support 15 can be made of foamed rubberlike material to provide light pressure over a broad portion of the user's hand without hindering flow of blood. Relaxed holding is made possible with the cushiony support 15. It allows users to devote attention to their physical activities and to other concerns instead of being distracted by gripping action.

Some users like to carry weights or other items while engaging in physical activities. For this reason, exercise-implement attachments such as one or more fastener orifices 16 can be positioned on the base plate 7 as depicted or elsewhere on the hand-held drink dispenser. The fastener orifices 16 can support a single item such as a weight 17. Optionally, an attachment bracket 18 can be provided with a plurality of bracket fasteners 19 which support an item fastener 20 with which select items can be positioned vertically as desired in relationship to the second housing 4 in a handle mode.

Figure 4:
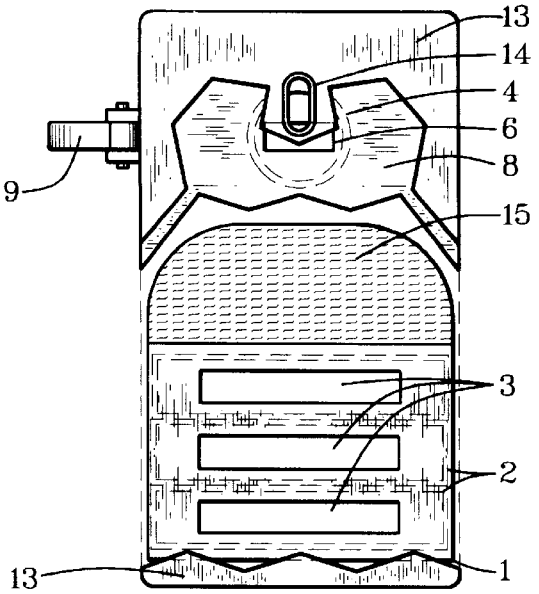
FIG. 4 is a partially cutaway plan view showing reservoir openings in relationship to a cushiony support, a handle, a funnel spout and a main housing.
Figure 5:
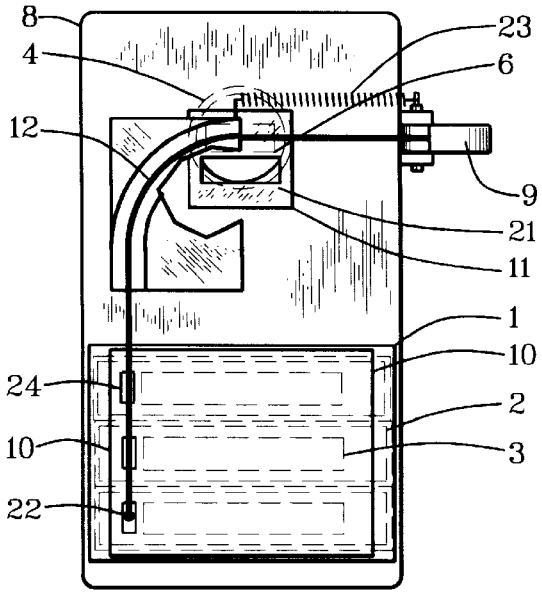
FIG. 5 is a partially cutaway plan view showing slide plates in relationship to openings and a valve means.
Figure 6:
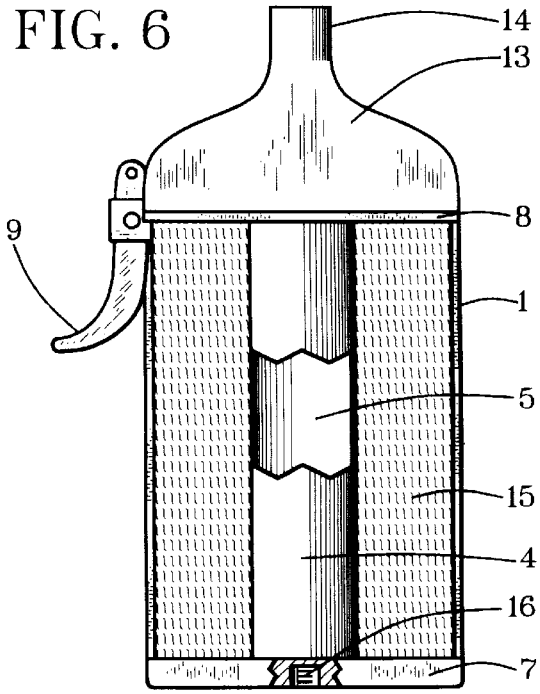
FIG. 6 is a partially cutaway front view of a left-handed dispenser.
Figure 7:
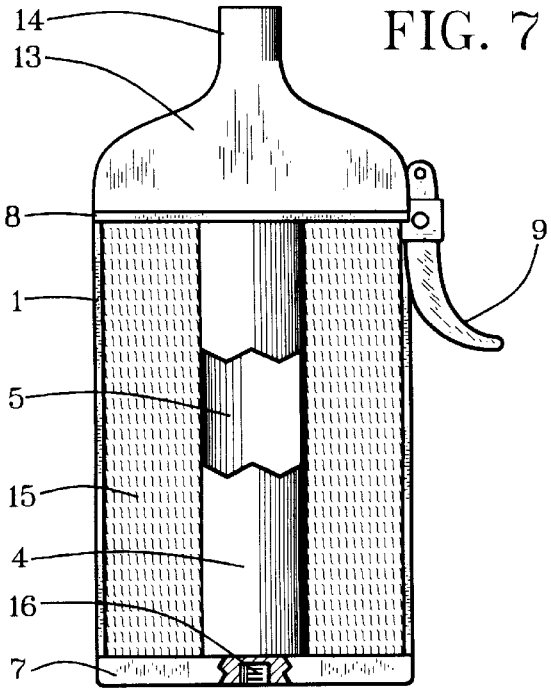
FIG. 7 is a partially cutaway front view of a right-handed dispenser.

Referring to FIGS. 4–7, a pair of two hand-held drink dispensers can have the same features but with one having the valve trigger 9 positioned for left-handed use as depicted in FIGS. 4 and 6 while the other has the valve trigger 9 positioned for right-handed use as depicted in FIGS. 5 and 7. A first-finger digit can be used to squeeze or press respective valve triggers 9.

For this preferred valve means, the first slide plate 10 has no openings but the second slide plate 11 can have a slide-plate opening 21. The first slide plate 10 is drawn towards the second slide plate 11 with the valve line 12 while opening first one and then the other of preferably three liquid reservoirs 2 one-at-a-time consecutively. After the last of the liquid reservoirs 2 is opened, the first slide plate 10 will be in a position to then slide the second slide plate 11 with further pull of the valve line 12 by continued pressure on the valve trigger 9. The valve line 12 can have a hook 22 with a ratchet-like operation in combination with a ratchet spring 23 and hook notches 24. Other ratchets and other valve means are foreseeable within the scope of this invention.

A new and useful hand-held drink dispenser having been described, all such foreseeable modifications, adaptations, substitutions of equivalents, mathematical possibilities of combinations of parts, pluralities of parts, applications and forms thereof as described by the following claims and not precluded by prior art are included in this invention.

What is claimed is:

1. A hand-held drink dispenser comprising:

an elongate upstanding main housing containing a plurality of elongate upstanding individual liquid reservoirs having openings at upper ends;

an elongate upstanding second housing containing an elongate upstanding liquid reservoir having an opening at an upper end and offset from the main housing with which the second housing is generally parallel, said second housing defining a handle spaced from said main housing such that said second housing is adapted to be grasped by the hand of a user, the hand being interposed between the main housing and the second housing, sealing means positioned selectively and separately in sealing and unsealing contact with the openings of the upper ends of the liquid reservoirs, the sealing means having a triggering means operable by a digit of a hand grasping the second housing to unseal the liquid reservoirs individually and sequentially; and a funneled cap enclosing the upper ends of the liquid reservoirs.

2. A hand-held drink dispenser as described in claim 1 wherein:

the funneled cap has a funnel spout that is sized and shaped to fit into the mouth of a user.

3. A hand-held drink dispenser as described in claim 1 and further comprising:

a cushiony support positioned intermediate the main housing and the second housing; and the cushiony support being sized, shaped and structured to apply light pressure against a back of a hand inserted between the main housing and the second housing.

4. A hand-held drink dispenser as described in claim 1 wherein:

the plurality of liquid reservoirs contained by the main housing is three.

5. A hand-held drink dispenser as described in claim 1 and further comprising:

an exercise-implement attachment on the dispenser.

6. A hand-held drink dispenser as described in claim 1 and further comprising:

a second hand-held drink dispenser having an elongate upstanding main housing containing a plurality of elongate upstanding individual liquid reservoirs having openings at upper ends, an elongate upstanding second housing containing an elongate upstanding liquid reservoir having an opening at an upper end and offset from the main housing with which the second housing is generally parallel, sealing means positioned selectively and separately in sealing and unsealing contact with the openings of the upper ends of the liquid reservoirs, the sealing means having a triggering means operable by a digit of a hand holding the dispenser to unseal the liquid reservoirs individually, and a funneled cap enclosing the upper ends of liquid reservoirs.

7. A hand-held drink dispenser as described in claim 1 wherein:

the funneled cap has a funnel spout that is sized and shaped to fit into mouths of users;

a cushiony support is positioned intermediate the main housing and the second housing;

the cushiony support being sized, shaped and structured to apply light pressure against a back of a hand inserted between the main housing and the second housing; and the plurality of liquid reservoirs contained by the main housing is three.

8. A hand-held drink dispenser as described in claim 7 and further comprising:

an exercise-implement attachment on the dispenser.

9. A pair of two hand-held drink dispensers respectively comprising:

an elongated upstanding main housing containing a plurality of elongate upstanding individual liquid reservoirs having openings at upper ends;

an elongate upstanding second housing containing an elongate upstanding reservoir liquid having an opening at an upper end and offset from the main housing with which the second housing is generally parallel, said second housing defining a handle spaced from said main housing such that said second housing is adapted to be grasped by the hand of a user, the hand being interposed between the main housing and the second housing;

sealing means positioned selectively and separately in sealing and unsealing contact with the openings of the upper ends of the liquid reservoirs;

the sealing means having a triggering means operable by a digit of a hand grasping the second housing to unseal the liquid reservoirs individually and sequentially;

a funneled cap enclosing the upper ends of the liquid reservoirs.

10. A hand-held drink dispenser as described in claim 9 wherein:

the funneled cap has a funnel spout that is sized and shaped to fit into the mouth of a user.

11. A hand-held drink dispenser as described in claim 9 and further comprising:

a cushiony support positioned intermediate the main housing and the second housing; and the cushiony support being sized, shaped and structured to apply light pressure against a back of a hand inserted between the main housing and the second housing.

12. A hand-held drink dispenser as described in claim 9 wherein:

the plurality of liquid reservoirs contained by the main housing is three.

13. A hand-held drink dispenser as described in claim 9 and further comprising:

an exercise-implement attachment on the dispenser.

* * * * *